United States Patent [19]

Nicholas et al.

[11] Patent Number: 4,651,488

[45] Date of Patent: Mar. 24, 1987

[54] EXPANSION JOINT FOR PLASTER WALLS

[76] Inventors: John D. Nicholas, 438 Russell Rd.; Larry M. Petree, 1077 Wildwood La., both of Lawrenceville, Ga. 30245; Julian J. Attaway, 571 Glen Eagles Cir., S.E., Marietta, Ga. 30067

[21] Appl. No.: 825,279

[22] Filed: Feb. 3, 1986

[51] Int. Cl.[4] ..... E04B 1/41

[52] U.S. Cl. ..... 52/396; 52/100; 404/68

[58] Field of Search ..... 52/393, 395, 396, 100, 52/710; 404/68, 72

[56] References Cited

U.S. PATENT DOCUMENTS

| | | | |
|---|---|---|---|
| 2,151,605 | 4/1938 | Lavering . | |
| 3,192,577 | 7/1965 | Barr | 52/396 X |
| 3,319,384 | 5/1967 | Berg | 52/100 |
| 3,512,318 | 5/1970 | Turner | 52/100 |
| 3,667,174 | 6/1972 | Arnett | 52/100 |
| 3,849,958 | 11/1974 | Balzer et al. | 52/396 |
| 3,951,562 | 4/1976 | Fyfe | 52/396 X |
| 3,964,220 | 6/1976 | Rutkowski et al. | 52/100 |
| 3,994,471 | 11/1976 | Turolla | 52/461 X |
| 4,141,189 | 2/1979 | Borjeson | 52/396 |

FOREIGN PATENT DOCUMENTS

| | | | |
|---|---|---|---|
| 2738429 | 3/1979 | Fed. Rep. of Germany | 52/396 |
| 1333580 | 6/1963 | France | 52/710 |

*Primary Examiner*—J. Karl Bell

*Attorney, Agent, or Firm*—Jones & Askew

[57] ABSTRACT

A unitary extruded plaster screed expansion joint for use in cast wall construction. The expansion joint includes a front wall and a first pair of opposing side walls extending rearwardly from the outer edges of the front wall. A second pair of opposing side walls extends rearwardly and outwardly from the rear edges of the first pair of opposing side walls. A pair of planar flanges extends laterally from the rearmost edges of the second pair of opposing side walls, and an inwardly and rearwardly arched wall connects the second pair of opposing side walls. The expansion joint is attached to a support surface, and plaster slabs are formed in place on the support surface adjacent to the expansion strip. The front wall is attached to the side walls of the expansion strip in such a manner as to prevent plaster residue from accumulating at the junctures therebetween, so that when the front wall is stripped away from the expansion joint, no plaster residue remains. As the adjacent plaster slabs expand, the forces brought to bear on the side walls cause the arched interior wall to deform; but since the arched wall is disposed rearwardly and outwardly of the first pair of opposing side walls, the joint is capable of complete closure until the first pair of side walls touch one another. Since the design of the joint affords a greater range of motion, fewer expansion joints can be used to accommodate the same amount of expansion; or, in the alternative, the same number of separators can be used but with narrower joints.

10 Claims, 6 Drawing Figures

EXPANSION JOINT FOR PLASTER WALLS

TECHNICAL FIELD

This invention relates generally to cast plaster wall construction, and relates more specifically to an improved plaster screed expansion strip for absorbing thermal expansion and contraction of adjacent plaster slabs.

BACKGROUND OF THE INVENTION

Cast wall construction wherein plaster slabs are formed in place on an underlying support structure are well known. As the plaster slabs are subjected to thermal expansion and contraction or to movement of the underlying support structure, such as by wind loading or settling, the plaster slabs tend to crack. It is well known that such cracking can be minimized by dividing the cast wall into a number of separate sections or slabs, as by the use of a channel or divider strip. In addition, in order to maintain constant thickness of the plaster slab during the casting process, it is helpful to provide a screeding surface.

A typical plaster screed expansion strip is shown in U.S. Pat. No. 3,667,174. This expansion strip comprises an elongated extrusion having a front wall, a pair of opposing side walls extending rearwardly of the front wall, a pair of lateral anchors extending outwardly of the side walls, and a rear wall including a pair of planar flanges for securing the expansion joint to the underlying support surface. The front wall is attached to the opposing side walls only by a thin web of plastic to form a "tear strip", whereby the front wall can be removed after the wall construction is complete. The rear wall is arched inwardly of the two side walls, this arched section being deformable in response to expansion forces exerted against the side walls by the adjacent plaster slabs. The front wall is substantially flush with the edges of the side walls, forming a screeding surface to serve as a guide for the thickness of the plaster slabs cast adjacent to the expansion joint.

A major drawback with the design disclosed in U.S. Pat. No. 3,667,174 is that the inwardly arched rear wall section is interposed between the side walls. Thus, as the adjacent plaster slabs expand and exert lateral forces against the side walls, the expansion strip can never fully contract until the side walls touch one another because the inwardly arched wall is always interposed therebetween. Accordingly, the minimum width to which the expansion strip can contract is limited to the combined thickness of the inwardly arched walls. The extent of this limitation can best be seen when viewed in the light of the dimensions of a typical expansion joint. Plaster screeding expansion joints similar to the aforementioned U.S. Pat. No. 3,667,174 are typically used to form a 0.25 inch joint. The inwardly arched walls are normally 0.025 inches thick, and the combined thickness of both inwardly arched walls is thus 0.050 inches. Accordingly, the minimum width to which the aforementioned joint can contract is 0.050 inches, which is 20% less than the total contraction which would be possible if the side walls were not prevented from touching one another by the inwardly arched rear wall. In other words, if the expansion joint could fully contract until the side walls touched one another, a joint 20% narrower could absorb the same thermal expansion, or 20% fewer joints of the same width would have to be installed to absorb the same thermal stresses.

Accordingly, there is a need to provide a thermal expansion strip for use in cast plaster wall construction which provides increased movement for improved absorption of thermal stresses imposed by adjacent plaster slabs, whereby either fewer expansion strips or narrower joints can be used to absorb thermal expansion stresses.

Another problem associated with the prior art plaster screed expansion joint as disclosed in the aforementioned U.S. Pat. No. 3,667,174 is that a pair of V-grooves are formed between the outer edges of the front wall and the inner edges of the side walls. During the process of finishing the plaster slabs adjoining the expansion joint, it is not uncommon for plaster to be splashed over the forward edges of the side walls and fill the V-groove. When this occurs, a residue of plaster remains on the face of the expansion joint when the forward wall or tear strips is removed. This residue presents an unsightly appearance and requires additional labor to remove from the expansion joint after the tear strip is disengaged.

Accordingly, there is a need to provide a plaster screed expansion joint which resists the accumulation of residue on its outer face during the screeding process.

SUMMARY OF THE INVENTION

As will be seen, the improved plaster screed expansion strip or joint of the present invention overcomes these and other problems associated with the prior art plaster screed expansion strips. Stated generally, the expansion strip of the present invention is designed to be mounted on a support wall to provide a screeding surface to facilitate the finishing of plaster slabs cast in place on the support wall on either side of the expansion strip. The front wall comprises a tear-away strip secured to the side walls in such a manner as to facilitate removal while preventing the accumulation of plaster residue on the forward face of the expansion strip. When installed, the expansion joint is compressible to absorb the expansion of the adjacent plaster slabs. The expansion joint is capable of completely closing until the side walls touch one another, thereby providing for greater absorption of the expansion stresses exerted by the adjoining plaster walls.

Stated more specifically, the improved plaster screed expansion strip of the present invention comprises an elongated extrusion of PVC plastic or the like, including a front wall and a first pair of substantially parallel opposing side walls projecting rearwardly from the edges of the front wall. A second pair of opposing side walls extend outwardly and rearwardly from the first pair of opposing side walls, and a pair of planar flanges project laterally from the rear edges of the second set of opposing side walls. An inwardly and rearwardly arched wall connects the second pair of opposing side walls and extends inwardly and rearwardly from a portion of the second side walls outwardly of the first pair of side walls such that when the arched wall is deformed in response to compression forces bearing against the side walls, the arched wall is disposed rearwardly of the first pair of opposing side walls, rather than interposed therebetween. The expansion joint is thereby capable of complete closure until the first pair of opposing side walls touch one another.

The planar flanges of the expansion joint are temporarily secured to the support surface. Plaster slabs are formed in place on the support surface adjacent the expansion joint. The forward edge of the expansion joint provides a screeding surface to which the plaster slabs are finished.

The front wall of the expansion joint comprises a tear strip which is selectively removable from the expansion joint upon completion of the screeding process. The front wall is inwardly arched in a substantially semi-circular configuration such that the rear face of the front wall is tangent to the inner surfaces of the first pair of opposing side walls, and the outer edges of the front wall are substantially coplanar with the forward edges of the first pair of opposing side walls. No external groove or indentation is formed along the juncture between the front wall and the first pair of opposing side walls, thereby preventing the accumulation of plaster residue at the juncture during the screeding process. Any plaster accumulated within the semi-circular face of the front wall during the screeding process is removed when the tear-away strip is separated from the expansion joint upon completion of the screeding process.

Thus, it is an object of the present invention to provide an improved plaster screed expansion joint.

It is a further object of the present invention to provide an expansion joint for plaster walls which more efficiently absorbs thermal expansion forces exerted by adjoining plaster slabs.

It is another object of the present invention to provide an expansion joint for plaster walls which is capable of complete closure.

It is yet another object of the present invention to provide a plaster screed expansion joint which avoids accumulations of plaster residue on the outer face of the expansion joint.

Other objects, features, and advantages of the present invention will become apparent upon reading the following specifications when taken in conjunction with the drawings and the appended claims.

DETAILED DESCRIPTION OF THE DISCLOSED EMBODIMENT

Figure 1:
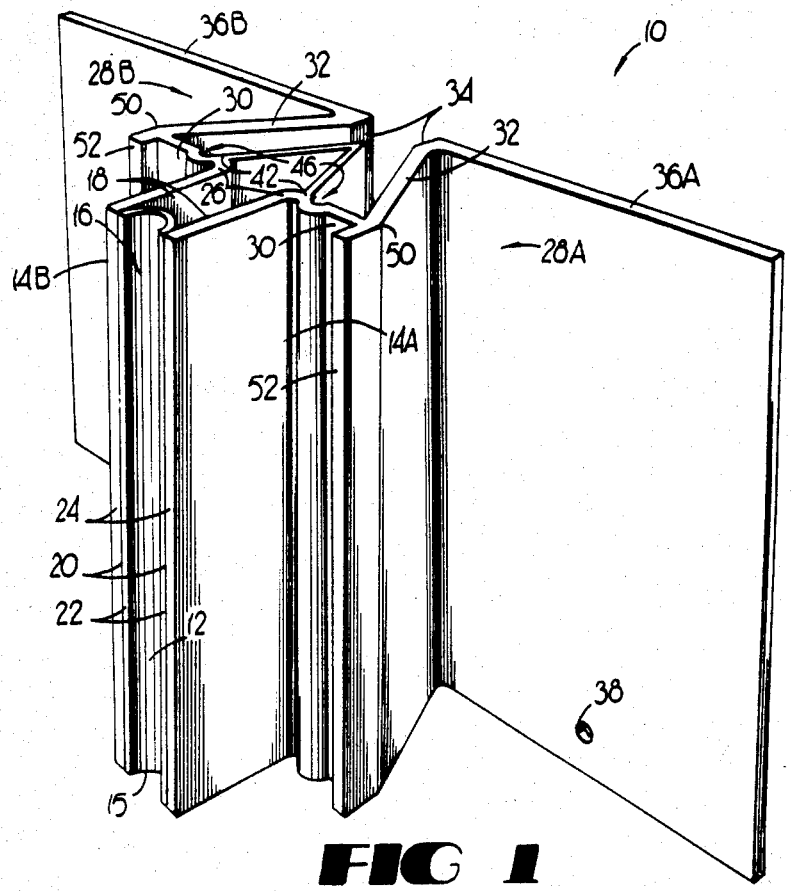
FIG. 1 is a perspective view of a first embodiment of the plaster screed expansion joint of the present invention.
Figure 2:
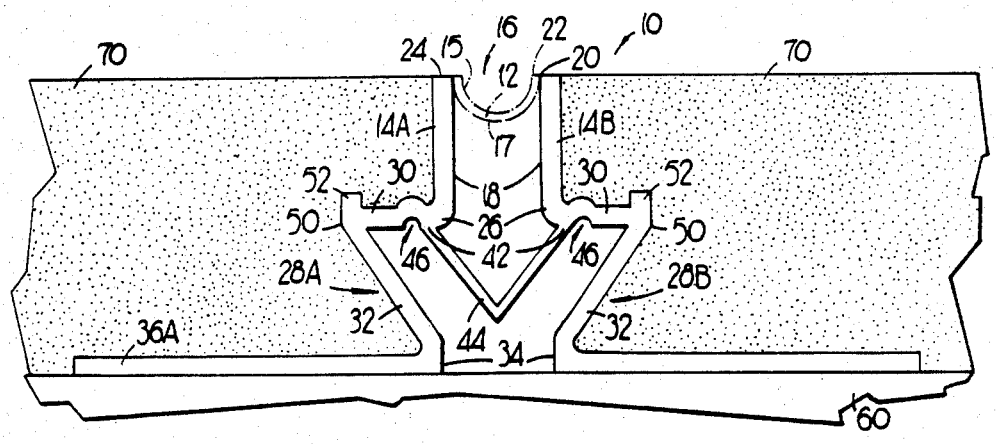
FIG. 2 is a top view of a cast wall construction featuring the plaster screed expansion joint of FIG. 1.
Figure 3:
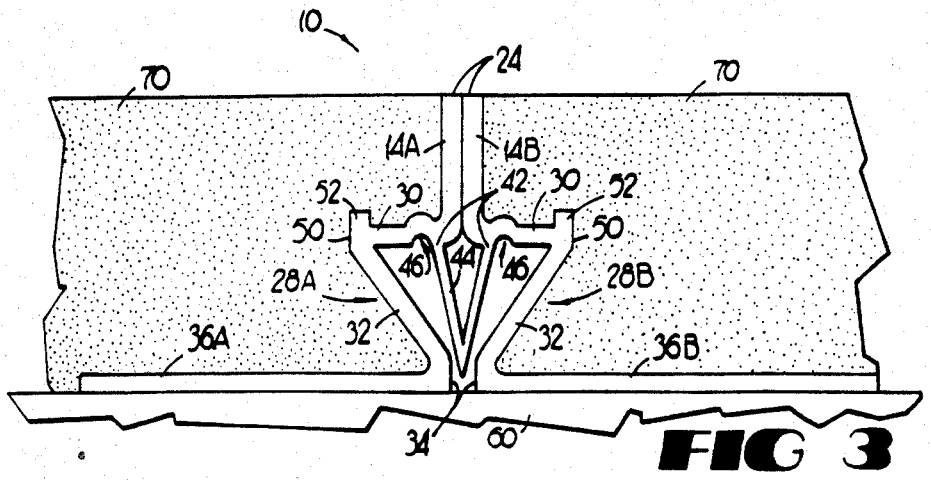
FIG. 3 is a top view of the cast wall construction of FIG. 2 showing the expansion joint in a closed configuration.

Referring now in more detail to the drawing, in which like numerals indicate like elements throughout the several views, FIGS. 1 through 3 show a first embodiment of an improved plaster screed expansion joint 10 according to the present invention. The expansion joint 10 is a unitary extrusion of PVC plastic or the like and includes a front wall 12 of substantially semi-circular configuration. A first pair of substantially parallel opposing side walls 14A, 14B project rearwardly from the front wall 12. The curved outer face 15 of the front wall 12 defines a concavity 16. The curved rear face 17 of the front wall 12 is tangent to the inner surfaces 18 of the first outer walls 14A, 14B at the junctures 20 therebetween. The outer edges 22 of the front wall 12 are substantially coplanar with the forward edges 24 of the first side walls 14A, 14B.

Extending from the rear edges 26 of the first side walls 14A, 14B are a second pair of side walls 28A, 28B, each comprising an outwardly extending portion 30 and a rearwardly extending portion 32. Laterally extending from the rear edges 34 of the second pair of side walls 28A, 28B are a pair of planar flanges 36A, 36B. Holes 38 dimensioned to receive screws or nails are formed in the planar flanges 36A, 36B to facilitate mounting the expansion joint 10.

Extending inwardly and rearwardly from a portion 42 of the second side walls 28A, 28B which is outwardly of the inner surface 18 of the first side walls 14A, 14B is an arched wall 44. The arched wall 44 is designed to connect the second pair of opposing side walls 28A, 28B and is deformable in response to lateral forces bearing inwardly against the side walls 14A, 14B, 28A, 28B. As shown in FIG. 2, the arched wall 44 of the preferred embodiment comprises a V-shape, but it will be understood that arched walls of the other shapes, including but not limited to U-shaped and W-shaped walls, may be employed to provide a deformable wall member to join the two halves of the expansion joint 10. To facilitate deformation of the arched wall 44 with respect to the second pair of opposing side walls 28A, 28B, a semi-circular stress indentation 46 is formed at the juncture 42 between the arched wall 44 and the outwardly projecting leg 30 of the second side walls 28A, 28B.

At the outer edges 50 of the laterally extending legs 30 of the second pair of opposing side walls 28A, 28B is a transverse anchor 52. The anchor 52 is designed to interlock mechanically with the adjoining plaster slabs to prevent the slabs from pulling away from the expansion joint during periods of contraction. It will be appreciated by those skilled in the art that other forms of mechanical interlocking between the plaster slabs and the expansion joint 10 may be employed, including serrations on the lateral surfaces such as the planar flanges 36A, 36B and the outwardly extending legs 30 of the second pair of opposing side walls 28A, 28B.

To use the plaster expansion joint 10 of the present invention, the planar flanges 36A, 36B of the expansion joint are tacked to a support surface 60 by temporary means such as a small amount of putty or the like. Plaster slabs 70 are then cast in place on the support surface 60. The plaster slabs 70 are finished by screeding the plaster to a thickness corresponding to the forward edge 24 of the plaster screed expansion joint 10. Any plaster which splashes over the forward edges 24 of the first side walls 14A, 14B during the screeding process will accumulate within the concavity 16 in the forward face 15 of the front wall 12. However, because there is no outwardly facing groove or indentation at the juncture 20 between the outer edges 22 of the front wall 12 and the forward edges 24 of the first side walls 14A, 14B, any plaster which accumulates within the concave forward face 15 of the front wall 12 will be removed when the forward wall is stripped away, and no plaster residue will remain on the outer face of the expansion strip as defined by the forward edges 24 of the first side walls 14A, 14B.

Upon completion of the wall construction, normal movement of the slabs 70 and the expansion joint 10 will break the temporary bond between the planar flanges 36A, 36B and the support surface 60. The expansion joint will be held in place by the plaster slabs, and the planar flanges will be free to move relative to the support surface as the slabs expand and contract.

As the adjacent plaster walls 70 are heated and expand, lateral forces are brought to bear on the side walls 14A, 14B and 28A, 28B. In response to these forces, the arched wall 44 deforms inwardly and downwardly as shown in FIG. 3, the indentation 46 relieving stresses exerted at the juncture 42 between the arched wall 44 and the outwardly extending legs 30 of the second side walls 28A, 28B. Because the arched wall 44 is disposed rearwardly of the first opposing side walls 14A, 14B, rather than being disposed therebetween, the expansion joint 10 is capable of complete closure until the first pair of opposing side walls 14A, 14B touch one another. As the plaster slabs 70 cool and contract, the mechanical interlock between the slabs and the lateral anchors 52 prevent the plaster slabs from pulling away from the expansion joint 10.

Because of the capability for complete closure realized by removal of the arched wall 44 from between the first pair of opposing side walls 14A, 14B, the expansion joint 10 of the present invention is capable of approximately 20% greater movement than prior art expansion joints. Accordingly, expansion joints may be placed at the same intervals but reduced in width from, for expansion, 0.25 inches to 0.20 inches, resulting in a more attractive appearance. Alternatively, expansion joints of the same width as prior art expansion joints, for example 0.25 inches, may be employed but spaced 25% farther part, whereby a 20% reduction in the number of expansion joints required may be realized.

If desired, the expansion joint 10 can also be used over a pre-existing joint where it is desired to cast a new wall over an old one. In that case, the expansion joint would be mounted to underlying plaster slabs which, unlike the continuous support surface 60, would themselves expand and contract. For those applications, the expansion joint 10 can be permanently mounted to the old slabs by nails or screws driven into the old slabs through the holes 38 in the planar flanges 36A, 36B. New plaster slabs are then cast in place over the pre-existing slabs. Moreover of the expansion joint is thus accomplished when the underlying pre-existing slabs expand and contract.

Figure 4:
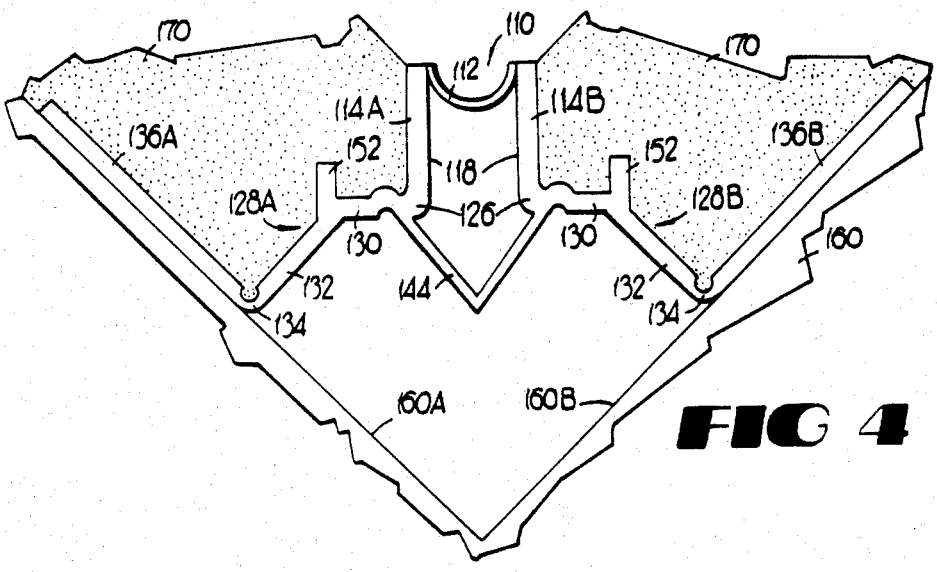
FIG. 4 is a top view of a cast wall construction featuring a second embodiment of the plaster screed expansion joint of the present invention.

FIG. 4 shows a second embodiment of an expansion joint 110 designed for use at an interior right angle corner of the cast wall construction. The expansion joint 110 includes a front wall 112 of substantially semi-circular shape. A first pair of substantially parallel opposing side walls 114A, 114B having inner surfaces 118 extend rearwardly from the front wall 112. From the rear edges 126 of the first opposing side walls 114A, 114B extend a second pair of opposing side walls 128A, 128B, each comprising outwardly extending legs 130 and downwardly extending legs 132. From the rearmost edges 134 of the second pair of opposing sides 128A, 128B project planar flanges 136A, 136B. However, where the planar flanges 36A, 36B of the expansion joint 10 were essentially coplanar for mounting the expansion joint on a flat support surface, and planar flanges 136A, 136B of the second embodiment 110 project forwardly and upwardly at a relative right angle to one another. In this manner, the rear of the expansion joint 110 as defined by the planar flanges 136A, 136B conforms to an interior right angle corner of the support surface.

An arched wall 144 connects the second pair of opposing side walls 128A, 128B in the manner hereinabove described for the expansion joint 10. Transverse anchor elements 152 project laterally from the outwardly extending legs 130 of the second pair of opposing side walls 128A, 128B.

To use the second embodiment 110 of the expansion joint of the present invention, the joint is first fastened to an interior right angle corner of the support surface 160 by securing the planar flanges 136A, 136B to adjacent walls 160A, 160B in the manner hereinabove described for the first embodiment 10. Plaster walls 170 are then formed in place on the support surface 160 and built up to a level corresponding to the forward edge of the expansion joint. Upon completion of the screeding, the forward wall 112 is removed.

As the plaster walls are heated and expand, forces are exerted against the side walls 114A, 114B, 128A, 128B. Responsive to these forces, the arched wall 144 deforms inwardly and downwardly. As before, the expansion joint 110 is capable of complete closure until the inner surfaces 118 of the first pair of opposing side walls 114A, 114B touch one another. When the slabs cool and contract, the transverse anchoring elements 152 are mechanically interlocked with the adjacent slabs, preventing the slabs from pulling away from the expansion joint.

Figure 5:
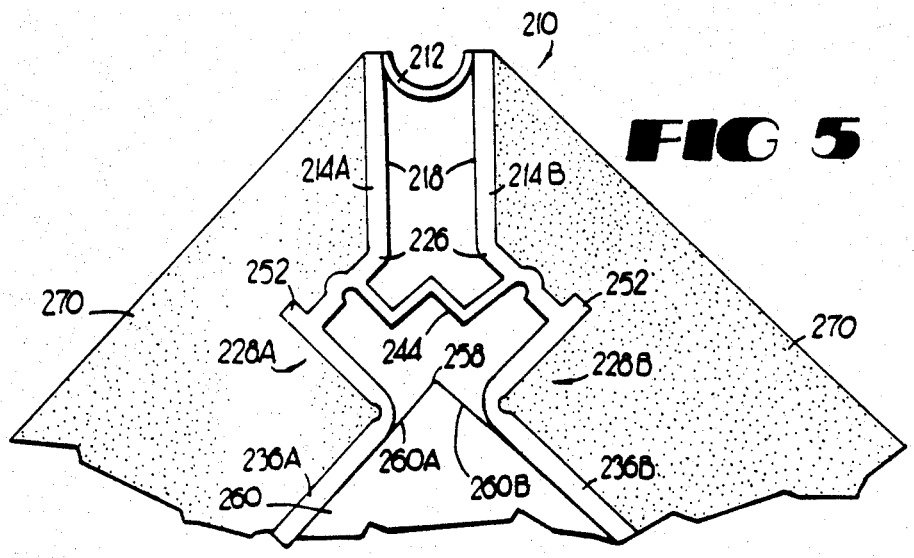
FIG. 5 is a top view of a cast wall construction featuring a third embodiment of the plaster screed expansion joint of the present invention.

A third embodiment 210 of the present invention is shown in FIG. 5 for an exterior right angle corner of the cast wall construction. The structure of the expansion joint 210 is similar to the expansion joints 10 and 110 described above and includes a front wall 212 having a substantially semi-circular shape. A first pair of side walls 214A, 214B having interior surfaces 218 extends rearwardly from the outer edges of the front wall 212. From the rear edges 226 of the first pair of opposing side walls 214A, 214B, a second pair of opposing side walls 228A, 228B comprising legs 230, 232 extend outwardly and rearwardly. From the rearmost edges 234 of the second pair of opposing sides 228A, 228B, a pair of planar flanges 236A, 236B project outwardly and rearwardly at a relative right angle to one another. An inwardly arched wall 244 connects the second pair of opposing side walls 228A, 228B. In this embodiment, a W-shaped arched wall 244 is employed to provide additional clearance between the arched wall and the exterior corner 258 of the support surface 260 projecting interiorly of the expansion joint 210. Transverse anchor elements 252 project laterally from the outwardly extending portions of the second pair of side walls 228A, 228B.

To use the third embodiment 210 of the expansion joint of the present invention, the expansion joint is fitted to the exterior right angle corner of the support surface 260 and the planar flanges 236A, 236B are secured to the adjacent walls 260A, 260B. Plaster slabs 270 are formed in place on the support surface 260 and are finished by screeding to a level corresponding to the forward edge of the first pair of opposing side walls 214A, 214B. The forward wall 212 is then torn away in the manner hereinabove described.

As the plaster slabs are heated and expand, compression forces are brought to bear on the side walls 214A, 214B, 228A, 228B. In response to these forces, the arched wall 244 deforms. Since the arched wall is not interposed between the first side walls 214A, 214B, the expansion joint 210 is capable of complete closure until the inner surfaces 218 of the first side walls contact one another. Transverse anchor elements 252 mechanically interlock with the plaster slabs, preventing the plaster from pulling loose from the anchor during contraction.

Figure 6:
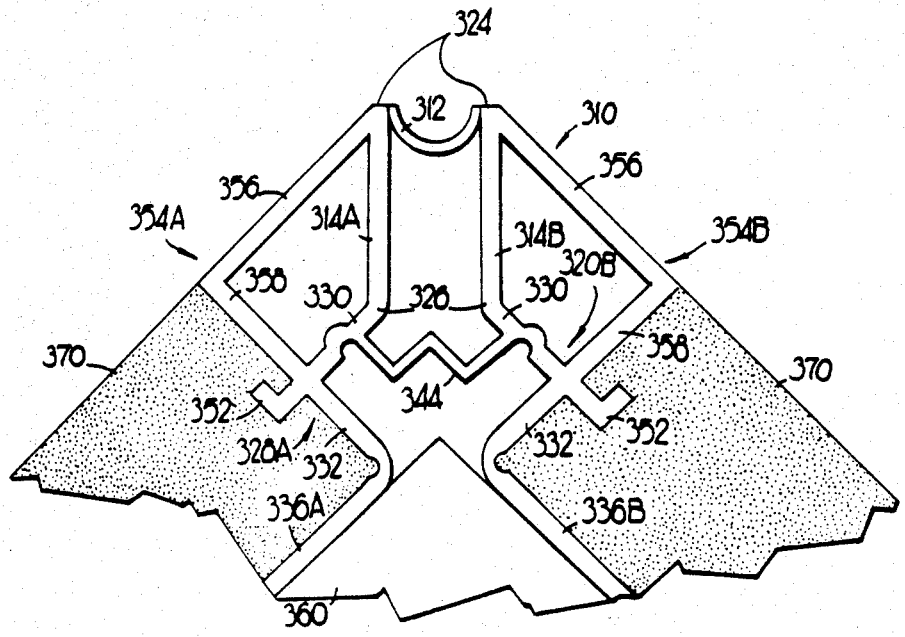
FIG. 6 is a top view of a cast wall construction featuring an alternate design of the third embodiment of the plaster screed expansion joint of the present invention.

It will be appreciated by those skilled in the art that a plaster slab formed adjacent to the expansion joint 210 will have a section of decreasing thickness at the edge of the slab adjacent the first pair of opposing side walls 214A, 214B. Under certain conditions, this tapered edge of the slab may be particularly susceptible to cracking. To alleviate this problem, an alternate design of the third embodiment has been provided. As shown in FIG. 6, the expansion joint 310 of the alternate embodiment includes a front wall 310 of substantially semicircular shape, and a first pair of side walls 314A, 314B extending rearwardly from the outer edges of the front wall 312 and having forward edges 324. From the rear edges 326 of the first pair of opposing side walls 314A, 314B, a second pair of opposing side walls 328A, 328B comprising legs 330, 332 extend outwardly and rearwardly. From the rear edges 334 of the second pair of opposing sides 328A, 328B, a pair of planar flanges 336A, 336B project outwardly and rearwardly at a relative right angle to one another. A W-shaped inwardly arched wall 344 connects the second pair of opposing side walls 328A, 328B. L-shaped anchor elements 352 project rearwardly and outwardly from the legs 332 of the second pair of side walls 328A, 328B.

A third pair of opposing side walls 354A, 354B depend outwardly and rearwardly from the forward edges 324 of the first pair of opposing side walls 314A, 314B. The third side walls 354A, 354B each comprise a first leg 356 extending outwardly and rearwardly at a relative right angle to one another, and a second leg 358 extending inwardly and rearwardly from the rearmost edges of the first legs 356. The second legs 358 are coplanar with the legs 332 of the second pair of opposing side walls 328A, 328B.

To use the expansion joint 310, the expansion joint is fitted to an exterior right angle corner of the support surface 360 in the same manner hereinabove described for the expansion joint 210. Plaster slabs 370 are formed in place on the support surface 360. The coplanar legs 332 and 358 project perpendicularly outwardly from the support surface 360 and provide a right angle surface to which the slabs 370 can abut. The slabs 370 are finished by screeding them to a level corresponding to the outer edge of the legs 356 of the third pair of opposing side walls 354A, 354B. The transverse anchor element 352 is securely embedded within the slabs 370 to prevent the slabs from pulling away from the expansion joint 310. Once installed, the expansion joint 310 functions in the manner hereinabove described for the expansion joint 210.

Finally, it will be understood that the preferred embodiment of the present invention has been disclosed by way of example, and that other modifications may occur to those skilled in the art without departing from the scope and spirit of the appended claims.

What is claimed is:

1. In a cast wall construction including a support surface and a pair of slabs cast in place on said support surface, the improvement comprising a unitary elongated expansion member interposed between said pair of slabs to absorb thermal expansion and contraction of said slabs, said elongated expansion member comprising:

a front wall;

a first pair of substantially parallel opposing side walls depending rearwardly from opposite edges of said front wall, said front wall being selectively removable from said first pair of side walls after said cast wall construction is complete;

a second pair of opposing side walls extending rearwardly and outwardly of said first pair of opposing side walls;

a pair of planar flanges projecting laterally from the rear edges of said second pair of opposing side walls for securing said expansion member to said support surface;

anchor means associated with said first or second pairs of side walls and disposed intermediate said front wall and said rear planar flanges for mechanically bonding said side walls to said slabs; and an arched wall connecting said second pair of opposing side walls and extending inwardly and rearwardly from a portion of said second side walls outwardly of said first pair of side walls such that when said arched wall is deformed in response to compression forces bearing against said pairs of side walls, and arched wall is disposed rearwardly of said first pair of opposing side walls and not therebetween, whereby said expansion member can be compressed until said first pair of opposing side walls touch one another.

2. The expansion member of claim 1, wherein said anchor means comprises lateral walls projecting outwardly from said first or second side walls, the width of said lateral walls varying in thickness so as to generate high and low points in relation to said wall, whereby said high and low points on said lateral walls interlock with said slabs to anchor said expansion member with respect thereto.

3. The expansion member of claim 1, wherein said anchor means comprises lateral walls projecting outwardly from said first or second pairs of side walls, each of said lateral walls having at least one projection extending transversely therefrom, whereby said transverse projections interlock with said slabs to anchor said expansion members with respect thereto.

4. The expansion member of claim 1, wherein said anchor means comprises serrations formed on the exterior surfaces of at least one of said first or second pairs of side walls or said planar flanges, whereby said serrations interlock with said slabs to anchor said expansion member with respect thereto.

5. The expansion member of claim 1, wherein said planar flanges are coplanar and project in opposite directions, whereby said expansion member can be secured to a planar support surface.

6. The expansion member of claim 1, wherein said support surface includes an exterior right-angle corner, and wherein said planar flanges project rearwardly at a right angle to one another, whereby said planar flanges can be secured to the surfaces of said support surface adjacent said exterior right-angle corner to secure said expansion member to said exterior right-angle corner.

7. The expansion member of claim 1, wherein said support surface includes an interior right-angle corner, and wherein said planar flanges project forwardly at a right angle to one another, whereby said planar flanges can be secured to the surfaces of said support surface adjacent said interior right-angle corner to secure said expansion member to said interior right-angle corner.

8. The expansion member of claim 1, further comprising stress relief hollows formed at the intersections of said planar flanges and each of said second pair of side walls, whereby said planar flanges are deformable with respect to said side walls to compensate for irregularities in said support surface.

9. The expansion member of claim 1, wherein said front wall is joined to said first pair of side walls by fracture webs of thinner cross-section then said front wall, whereby said front wall forms a tear strip selectively removable from said first pair of side walls after said cast wall construction is complete.

10. The expansion member of claim 1, wherein said front wall is inwardly arched in a substantially semicircular shape such that the rear surface of said front wall is substantially tangent to the inner surfaces of said opposing first side walls, and the lateral edges of said front wall are substantially coplanar with the forward edges of said first pair side walls, whereby no voids or hollows are formed in the forward face of said expansion member at the junctures between said front wall and said first pair of side walls.

* * * * *